US007532178B2

(12) United States Patent
Lee

(10) Patent No.: US 7,532,178 B2
(45) Date of Patent: May 12, 2009

(54) DISPLAY PANEL DRIVING APPARATUS

(75) Inventor: Joo-Yul Lee, Asan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 528 days.

(21) Appl. No.: 11/075,335

(22) Filed: Mar. 9, 2005

(65) Prior Publication Data

US 2005/0200299 A1 Sep. 15, 2005

(30) Foreign Application Priority Data

Mar. 10, 2004 (KR) ..... 10-2004-0016096

(51) Int. Cl.
*G09G 3/28* (2006.01)

(52) U.S. Cl. ..... 345/60; 315/169.1; 315/169.4

(58) Field of Classification Search ..... 345/87–104, 345/208; 315/169.1, 169.4
See application file for complete search history.

(56) References Cited

U.S. PATENT DOCUMENTS

2003/0025654 A1* 2/2003 Jin et al. ..... 345/60

FOREIGN PATENT DOCUMENTS

| | | |
|---|---|---|
| CN | 1405746 | 3/2003 |
| CN | 1450512 | 10/2003 |
| JP | 11-073156 | 3/1999 |
| JP | 2001-228821 | 8/2001 |
| JP | 2003-015600 | 1/2003 |
| JP | 2003-076323 | 3/2003 |
| JP | 2003-330405 | 11/2003 |
| KR | 1020030013029 | 2/2003 |

OTHER PUBLICATIONS

Chinese Office Action mailed Mar. 7, 2008.

* cited by examiner

*Primary Examiner*—Richard Hjerpe
*Assistant Examiner*—Christopher E Leiby
(74) *Attorney, Agent, or Firm*—H.C. Park & Associates, PLC

(57) ABSTRACT

A display panel driving apparatus that applies a rising ramp voltage in a reset period includes a first voltage applying unit outputting the first voltage, a second voltage applying unit outputting the second voltage, a first ramp switching unit coupled between the first and second voltage applying units to control the rising ramp voltage, and a first scanning switching unit coupled between the first ramp switching unit and the electrode to apply a high level scanning voltage to the electrode. The rising ramp voltage is applied to the electrode when the first voltage is output from the first voltage applying unit, the first ramp switching unit is turned on, and the first scanning switching unit is turned on. A ramp reset signal is generated without a conventional path switch that carries out a rising ramp interval in the reset period.

14 Claims, 15 Drawing Sheets

DISPLAY PANEL DRIVING APPARATUS

CROSS REFERENCE TO RELATED APPLICATION

This application claims priority to and the benefit of Korean Patent Application No. 10-2004-0016096, filed on Mar. 10, 2004, which is hereby incorporated by reference for all purposes as if fully set forth herein.

BACKGROUND OF THE INVENTION

1. Field of the Invention

The present invention relates to a display panel driving apparatus used in a typical plasma display panel (PDP).

2. Discussion of the Background

FIG. 1 shows a typical three-electrode surface-discharge type PDP.

As shown in FIG. 1, address electrode lines $A_1, A_2, \ldots, A_m$, dielectric layers 102 and 110, Y-electrode lines $Y_1, \ldots, Y_n$, X-electrode lines $X_1, \ldots, X_n$, a fluorescent layer 112, partition walls 114, and a protection layer 104 are provided between front and rear glass substrates 100 and 106.

The address electrode lines $A_1, A_2, \ldots, A_m$ are formed on the rear glass substrate 106 and covered by a lower dielectric layer 110. The partition walls 114 are formed on the lower dielectric layer 110 and in parallel with the address electrode lines $A_1, A_2, \ldots, A_m$. The partition walls 114 partition discharge areas in, and prevent optical interferences between, the display cells. The fluorescent layer 112 is formed on the lower dielectric layer 110 and the sides of the partition walls 114.

The Y-electrode lines $Y_1, \ldots, Y_n$ and the X-electrode lines $X_1, \ldots, X_n$, are formed on the front glass substrate 100, and they are arranged substantially orthogonally to the address electrode lines $A_1, A_2, \ldots, A_m$. Each intersection of an address electrode line and an X and Y electrode line pair establishes corresponding display cells. The Y-electrode lines $Y_1, \ldots, Y_n$ and the X-electrode lines $X_1, \ldots, X_n$ may comprise transparent electrode lines $X_{na}$ and $Y_{na}$, which may be made from a transparent conductive material such as an indium tin oxide (ITO) film, and metallic electrode lines $X_{nb}$ and $Y_{nb}$, which increase electrode conductivity. The upper dielectric layer 102 covers the Y-electrode lines $Y_1, \ldots, Y_n$ and the X-electrode lines $X_1, \ldots, X_n$. The protection layer 104, which is typically a MgO layer, covers the upper dielectric layer 102 and protects the panel 1 from a strong electric field. A sealed discharge space 108 has a gas for generating plasma.

A typical driving method for such a PDP may include several operations such as sequentially performed reset, address, and sustain periods in each unit subfield. In the reset is period, all display cells are provided with uniform charge conditions. In the address period, the charge conditions of selected and non-selected display cells are established. In the sustain period, a display discharge is performed in the selected display cells to generate plasma, which emits ultraviolet light, thereby exciting the fluorescent layer 112 of the display cells to emit light.

FIG. 2 illustrates a typical driving apparatus for the PDP shown in FIG. 1.

A typical PDP 1 driving apparatus includes an image processing unit 200, a logic control circuit 202, an address driver 206, an X-driver 208, and a Y-driver 204. The image processing unit 200 converts an external image signal into internal image signals, such as 8 bit data representing red, green, and blue colors, a clock signal, and vertical and horizontal synchronization signals. The logic control circuit 202 generates driving control signals $S_A$, $S_Y$, and $S_X$ according to the internal image signal from the image processing unit 200. The address driver 206 processes the address signal $S_A$ to generate and apply display data signals to the address electrode lines. The X-driver 208 processes the X-driving control signal $S_X$ and applies it to the X-electrode lines $X_1, \ldots, X_n$. The Y-driver 204 processes the Y-driving control signal $S_Y$ and applies it the Y-electrode lines $Y_1, \ldots, Y_n$.

U.S. Pat. No. 5,541,618 discloses an address-display separation driving method that may be used to drive the PDP 1.

FIG. 3 shows a typical address-display separation method for driving the Y-electrode lines shown in FIG. 1.

A unit frame may be divided into a plurality of subfields, (e.g., 8 subfields $SF_1$, $SF_8$), to implement a time division gradation display. Each subfield $SF_1, \ldots, SF_8$ may be further divided into a reset period (not shown), an address period $A_1, \ldots, A_8$, and a sustain period $S_1, \ldots, S_8$.

In each address period $A_1, \ldots, A_8$, display data signals may be applied to the address electrode lines $A_1, A_2, \ldots, A_m$ in FIG. 1, and, simultaneously, corresponding scanning pulses may be applied to respective Y-electrode lines $Y_1, \ldots, Y_n$.

In each sustaining period $S_1, \ldots, S_8$, display discharge pulses may be alternately applied to the Y-electrode lines $Y_1, \ldots, Y_n$ and the X-electrode lines $X_1, \ldots, X_n$ to generate a display discharge in the selected discharge cells.

A PDP's luminance is proportional to the number of sustaining pulses occupying the sustaining periods $S_1, \ldots, S_8$ in a unit frame. As shown in FIG. 3, a frame forming one image may be represented by 8 subfields and 256 gradation levels, where different numbers of sustaining pulses are allocated to each subfield at a rate of 1 T, 2 T, 4 T, 8 T, 16 T, 32 T, 64 T, and 128 T, where T is a unit of time. Therefore, for example, to obtain a luminance corresponding to a gradation level of 133, cells may be addressed and sustain discharged during a period including $SF_1$, $SF_3$, and $SF_8$.

The number of sustaining discharges allocated to each subfield may vary according to weights of the subfields based on an automatic power control (APC) operation. Additionally, they may be modified considering gamma characteristic or panel characteristics. For example, a gradation level allocated to $SF_4$ may be decreased from 8 to 6, and a gradation level allocated to $SF_6$ may be increased from 32 to 34. Furthermore, the number of subfields forming one frame may be modified as required.

FIG. 4 is a timing chart showing driving signals that may applied to the address electrodes $A_1$:$A_m$, the common electrodes $X_1$:$X_n$, and the scanning electrodes $Y_1$:$Y_n$ in a subfield $SF_n$ according to an address display separated (ADS) driving method of an AC PDP. The subfield $SF_n$ includes a reset period PR, an address period PA, and a sustain period PS.

In the reset period PR, reset pulses may be applied to all groups of scanning lines generate a writing discharge and initialize wall charge states of all panel cells so that they have similar wall charge conditions. In the subsequent address period PA, display cells may be selected by applying a bias voltage $V_e$ to the common electrode $X_1$:$X_n$ and simultaneously turning on the scanning electrodes $Y_1$:$Y_n$ and the address electrodes $A_1$:$A_m$. In the following sustain period PS, the sustaining pulse $V_s$ may be alternately applied to the common electrode $X_1$:$X_n$ and the scanning electrode $Y_1$:$Y_n$ while applying a ground voltage to the address electrodes $A_1$:$A_m$.

FIG. 5 is a timing chart showing another example of driving signals that may be applied to the PDP 1 shown in FIG. 1. Unlike FIG. 4, FIG. 5 shows a high level voltage $V_{SC\text{-}H}$ of the scanning electrode, in the address period PA, that is less than a low level sustaining voltage, e.g., a ground voltage.

However, in order to implement such wave form signals, a conventional circuit may require expensive and complicated components. The present invention provides simplified and less expensive driving circuits.

SUMMARY OF THE INVENTION

The present invention provides a display panel driving apparatus having a rising ramp interval control circuit with an improved structure.

Additional features of the invention will be set forth in the description which follows, and in part will be apparent from the description, or may be learned by practice of the invention.

The present invention discloses a display panel driving apparatus for applying a rising ramp voltage rising from a first voltage to a second voltage in a reset period to at least one electrode included in a display panel. The display panel driving apparatus comprises a first voltage applying unit outputting the first voltage, a second voltage applying unit outputting the second voltage, a first ramp switching unit coupled between the first and second voltage applying units to control the rising ramp voltage, and a first scanning switching unit coupled between the first ramp switching unit and the electrode to apply a high level scanning voltage to the electrode. The rising ramp voltage is applied to the electrode when the first voltage is output from the first voltage applying unit, the first ramp switching unit is turned on, and the first scanning switching unit is turned on.

The present invention also discloses a display panel driving apparatus for applying a rising ramp voltage rising from a first voltage to a second voltage in a reset period to at least one electrode included in a display panel. The display panel driving apparatus comprises a first voltage applying unit outputting the first voltage, a second voltage applying unit outputting the second voltage, a first ramp switching unit coupled between the first and second voltage applying units to control the rising ramp voltage, and a first scanning switching unit coupled between the second voltage applying unit and the first ramp switching unit to apply the second voltage to the electrode as a high level scanning voltage. The rising ramp voltage is applied to the electrode when the first voltage is output from the first voltage applying unit, the first ramp switching unit is turned on, and the first scanning switching unit is turned on.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
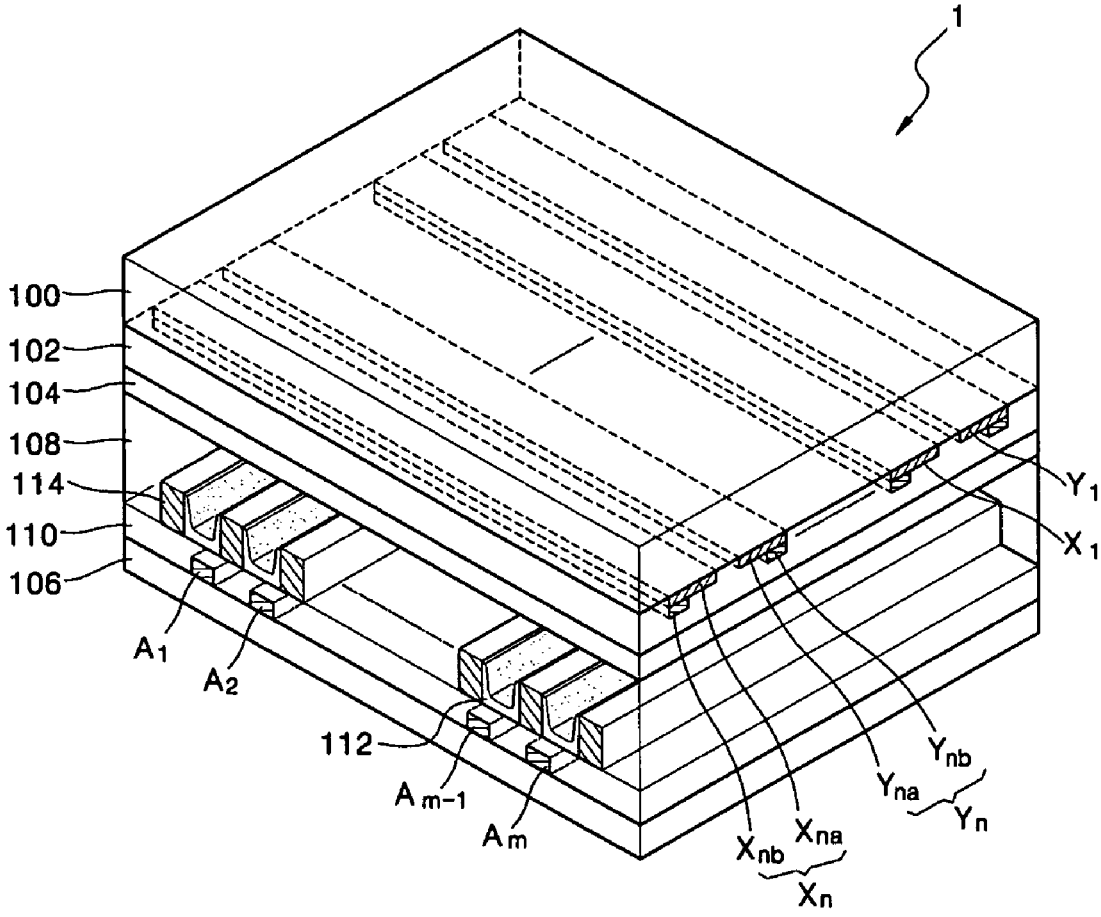
FIG. 1 (PRIOR ART)
FIG. 1 shows a typical three-electrode surface-discharge type PDP.
Figure 2:
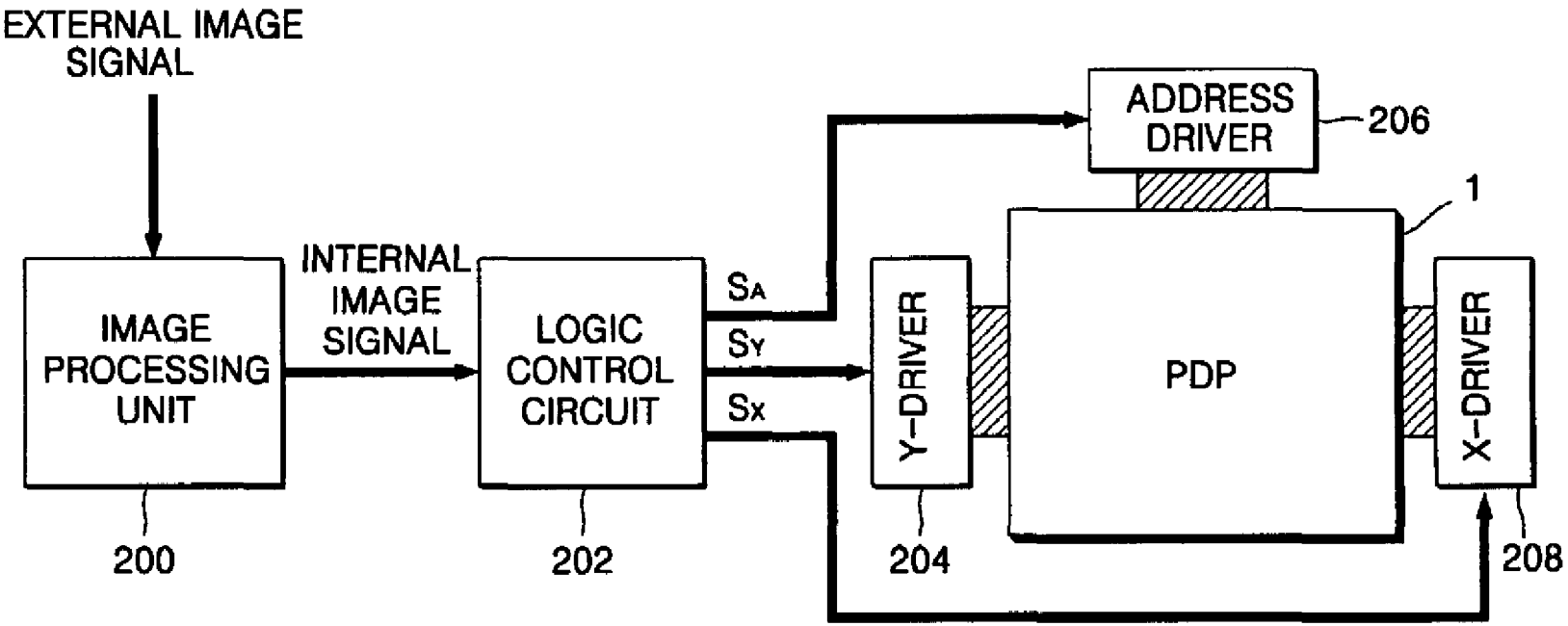
FIG. 2 (PRIOR ART)
FIG. 2 shows a typical driving apparatus for the PDP shown in FIG. 1.
Figure 3:
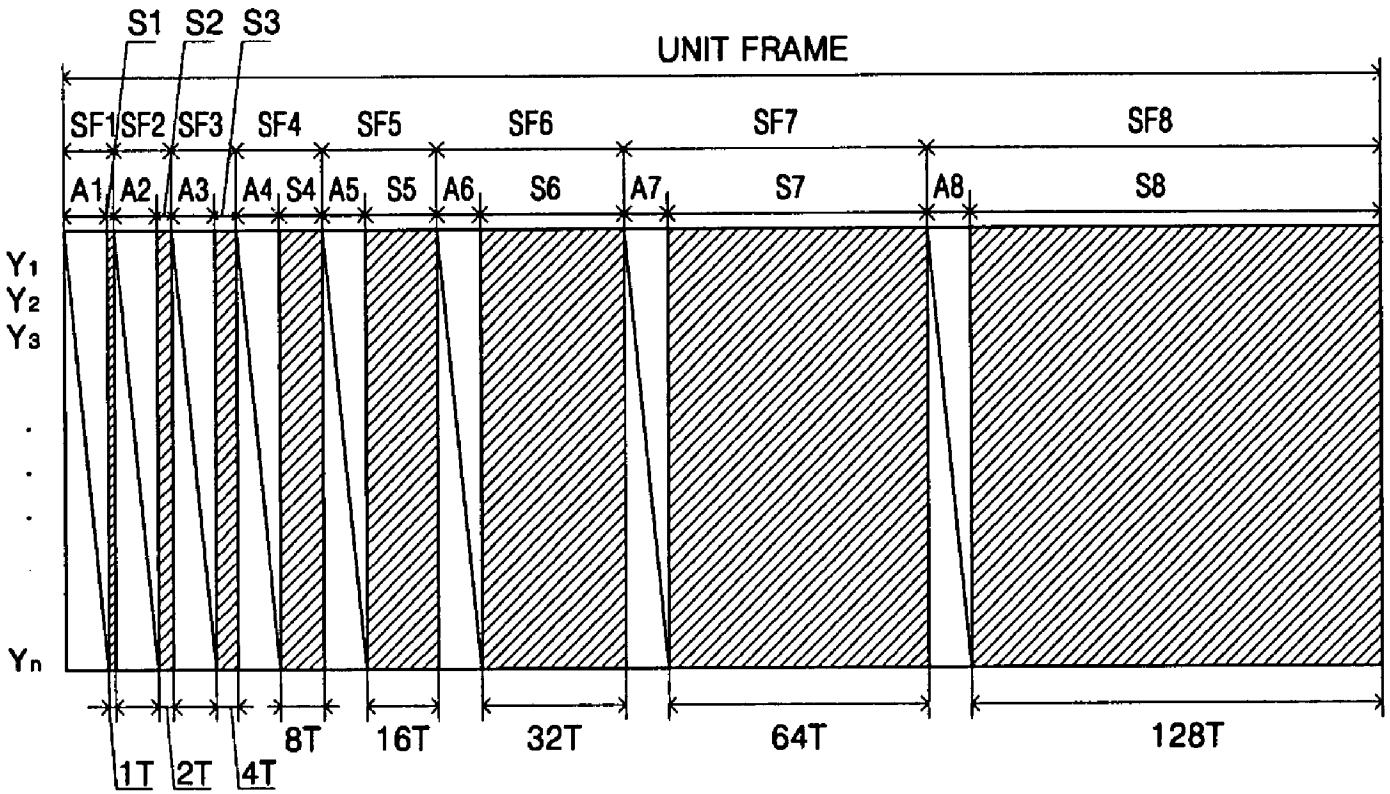
FIG. 3 (PRIOR ART)
FIG. 3 shows a typical address-display separation method for driving Y-electrode lines of the PDP shown in FIG. 1.
Figure 4:
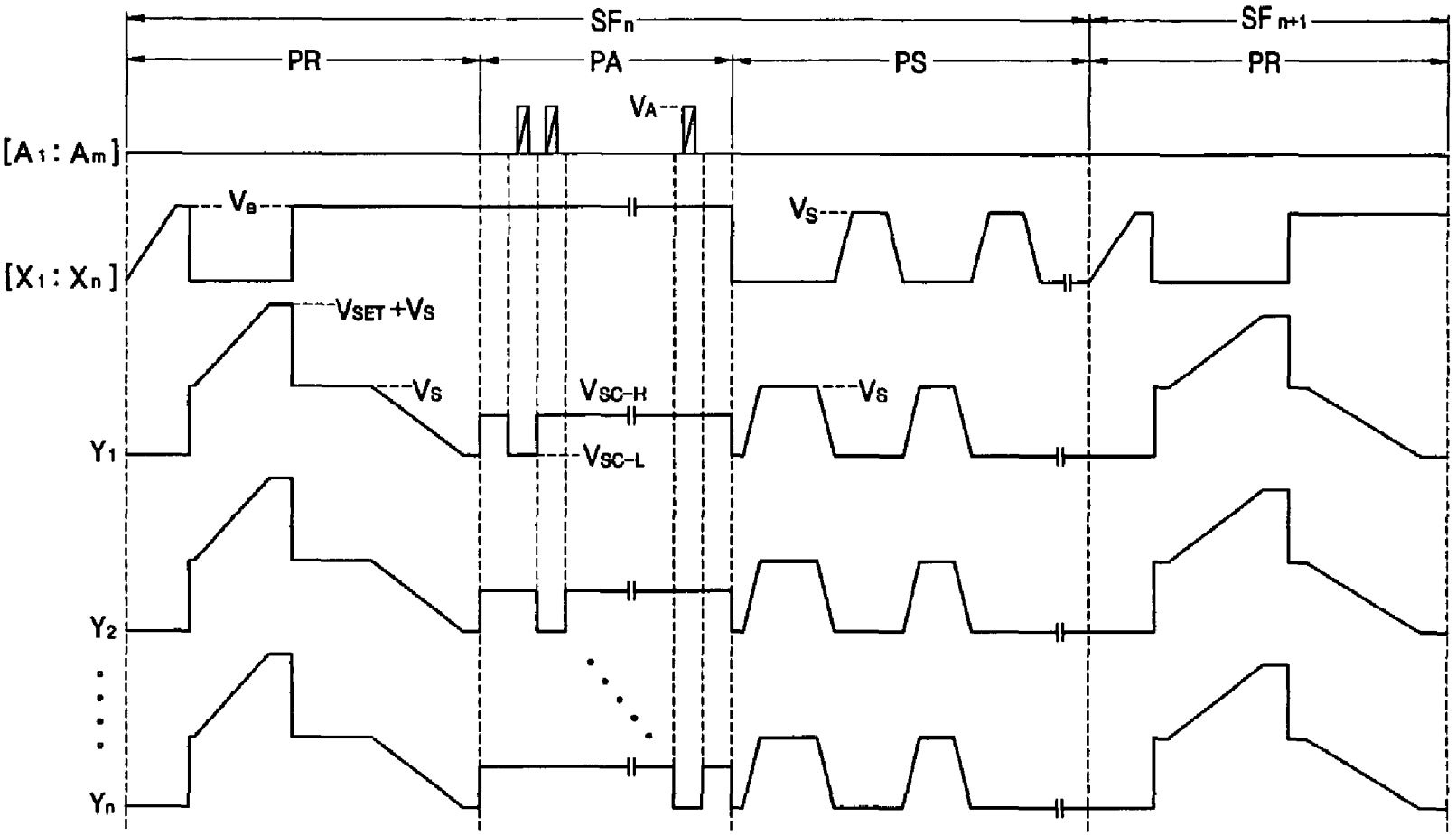
FIG. 4 (PRIOR ART)
FIG. 4 is a timing chart for describing driving signals of the PDP shown in FIG. 1.
Figure 6:
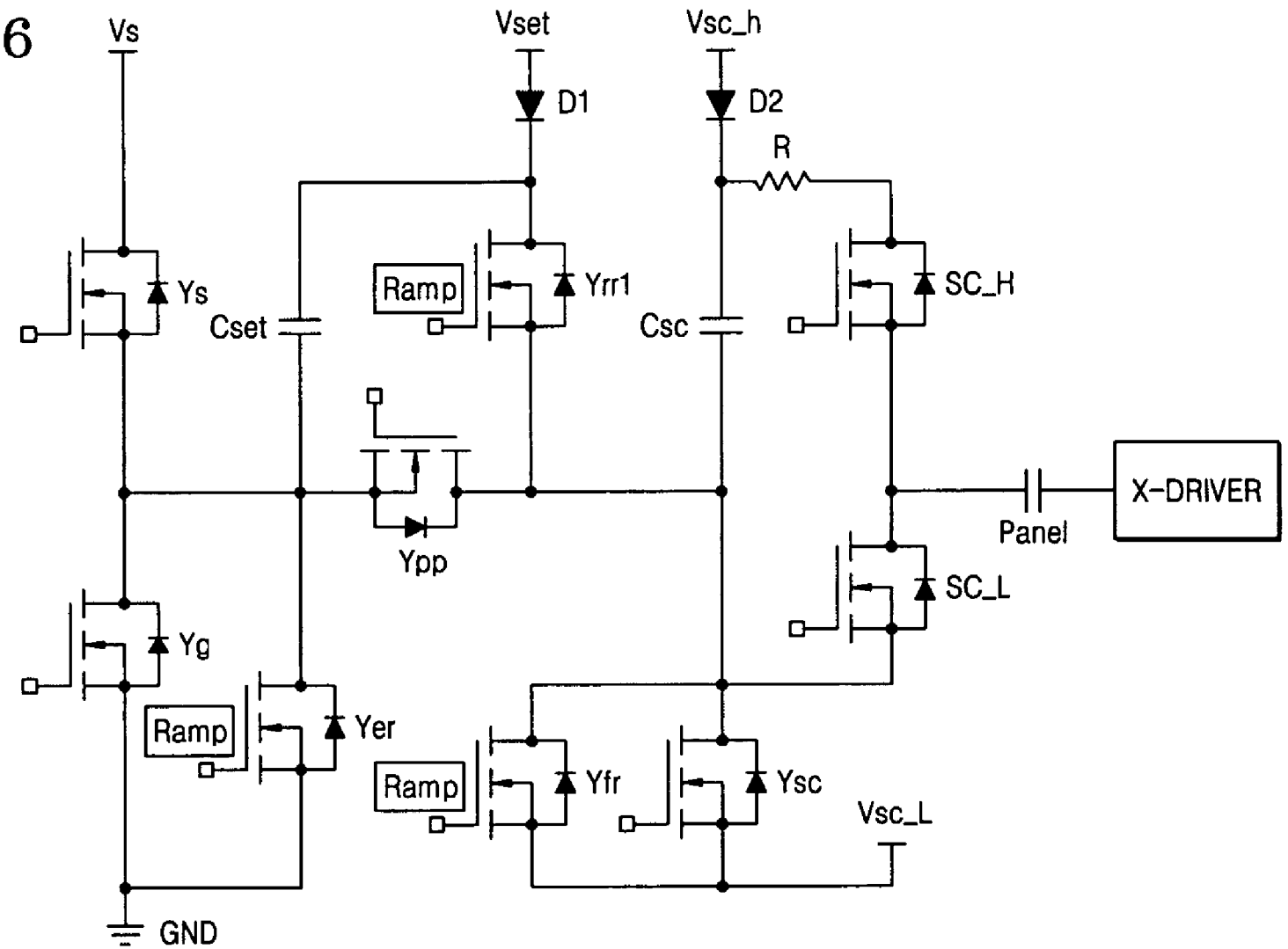
FIG. 6 is a circuit diagram showing a circuit for implementing the panel driving signals shown in FIG. 4.

FIG. 6 is a circuit diagram for implementing the driving signals shown in FIG. 4. Though not shown, an energy recovery circuit may be connected to a node between switches $Y_s$ and $Y_g$. The energy recovery circuit may include at least a capacitor and an inductor to improve power consumption efficiency by using an LC resonance between the panel capacitance and the inductor. U.S. Pat. No. 4,866,349 discloses such an energy recovery circuit.

Referring to FIG. 6, the rising ramp interval $V_s$: $V_{SET}+V_s$, of the reset period PR of FIG. 4, is carried out with the path switch Ypp turned off and with the path composed of $V_s$, $Y_s$, $C_{set}$, $Y_{rr1}$, SC_L, and Panel. The switch $Y_{rr1}$ controls the rising ramp inclination.

Further, the falling ramp interval $V_s$: $V_{SC_L}$, of the reset period PR of FIG. 4, is carried out with the path switch Ypp turned on and by using the path composed of $Y_{fr}$, SC_L, and Panel. The switch $Y_{fr}$ controls the falling ramp inclination.

Figure 7:
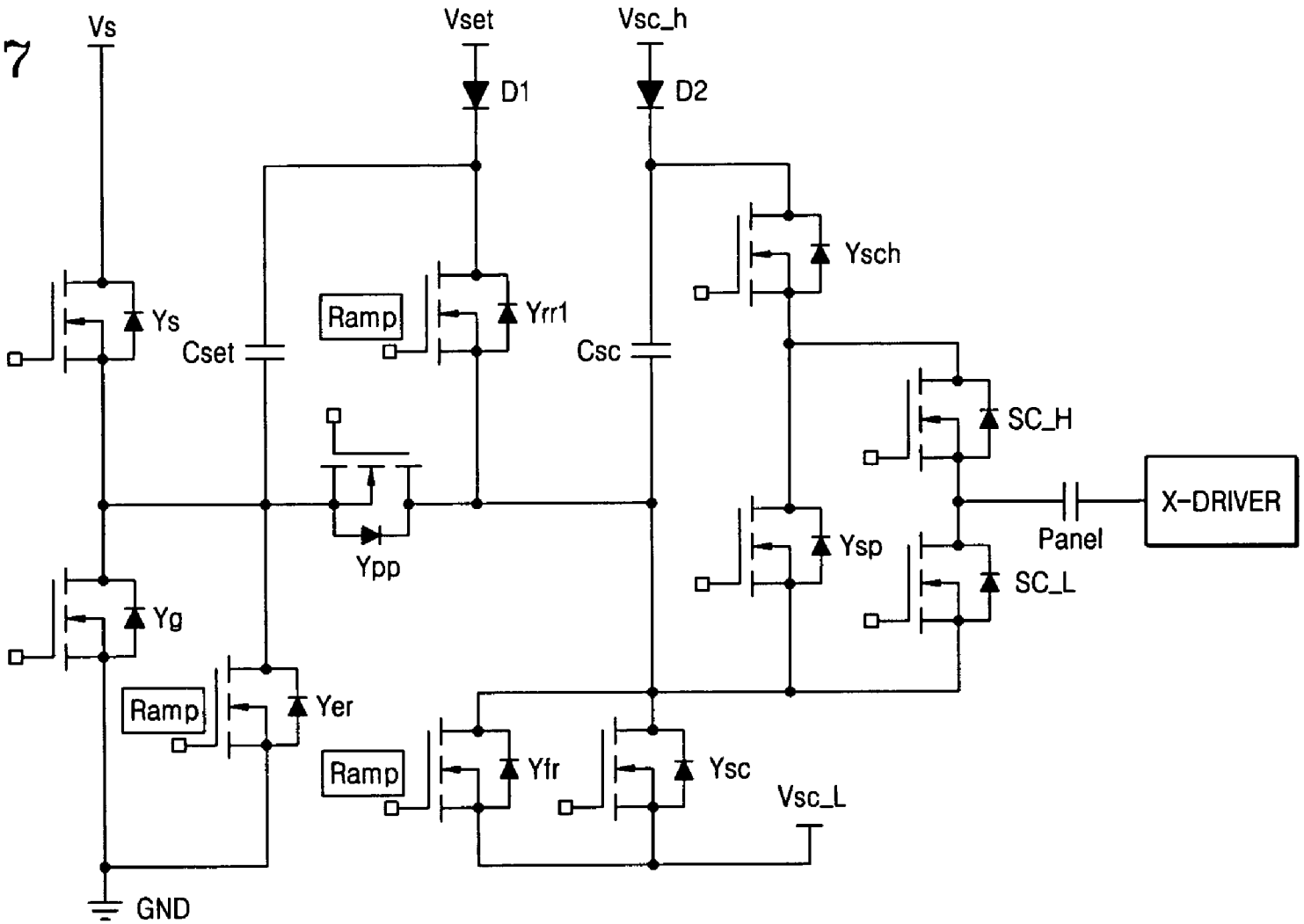
FIG. 7 is another circuit diagram showing a circuit for implementing the panel driving signals shown in FIG. 4.

FIG. 7 is another circuit diagram showing a circuit for implementing the driving signals shown in FIG. 4. Though not shown, an energy recovery circuit may be connected to a node between the switches $Y_s$ and $Y_g$. Differences from FIG. 6 include the added switches $Y_{sch}$ and $Y_{sp}$.

Switching operations for carrying out the reset period PR are similar to those of FIG. 6. On the other hand, switching operations for carrying out the address period PA and the sustain period PS may be performed as described below.

In the addressing period PA, a high level scanning voltage $V_{sc_h}$ may be applied to the panel via switches $Y_{sch}$ and SC_H, and a low level scanning voltage $V_{sc_L}$ may be applied via switches $Y_{sc}$ and SC_L.

In the sustain period PS, a voltage rising from a low level to a high level and then maintaining a high level of Vs is applied via switches $Y_{pp}$, $Y_{sp}$, and SC_H. Furthermore, a voltage decreasing from a high level to a low level and then maintaining the low level is applied via switches $Y_{pp}$ and SC_L.

Figure 5:
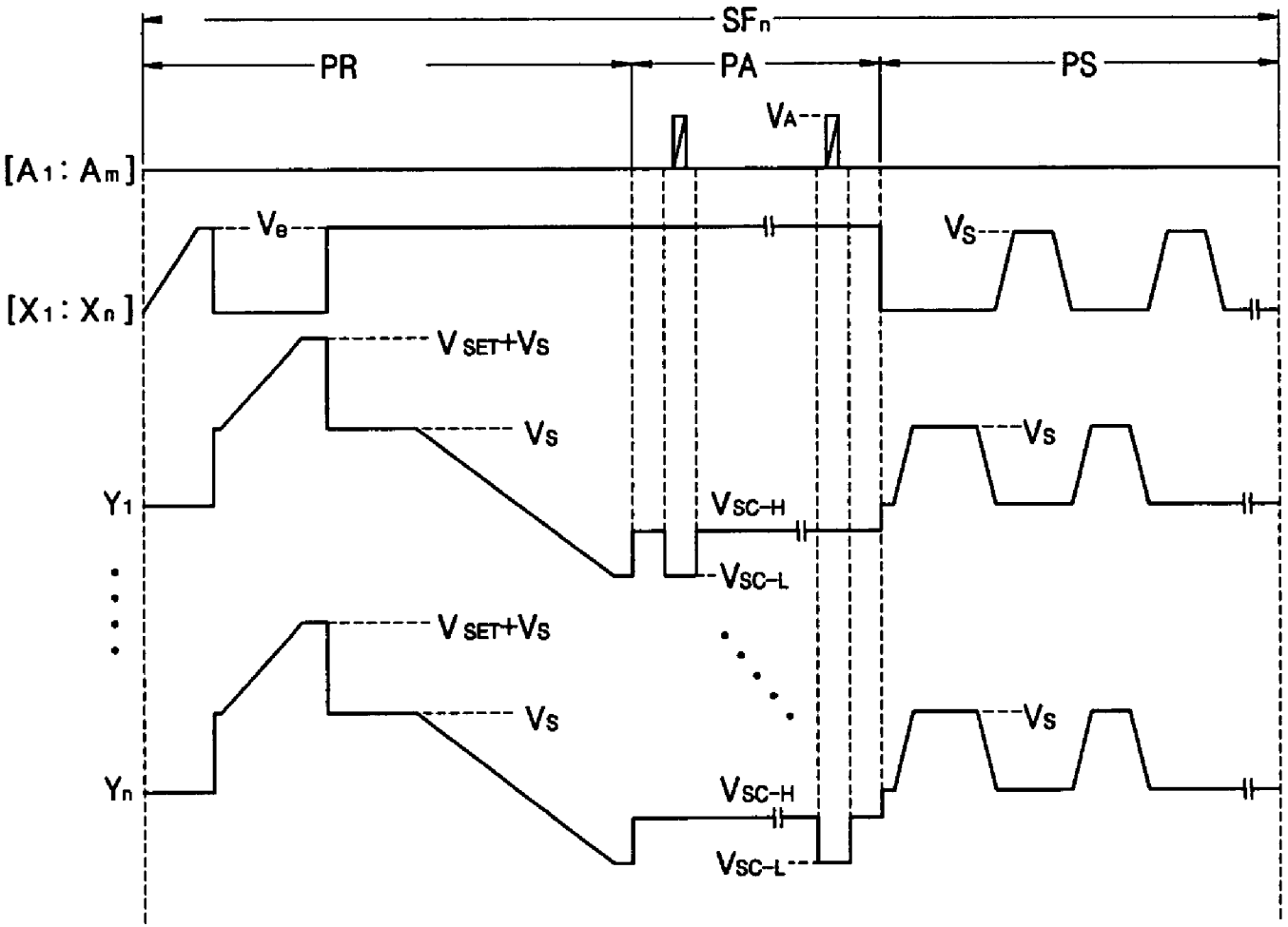
FIG. 5 (PRIOR ART)
FIG. 5 is a timing chart for describing another set of driving signals of the PDP shown in FIG. 1.
Figure 8:
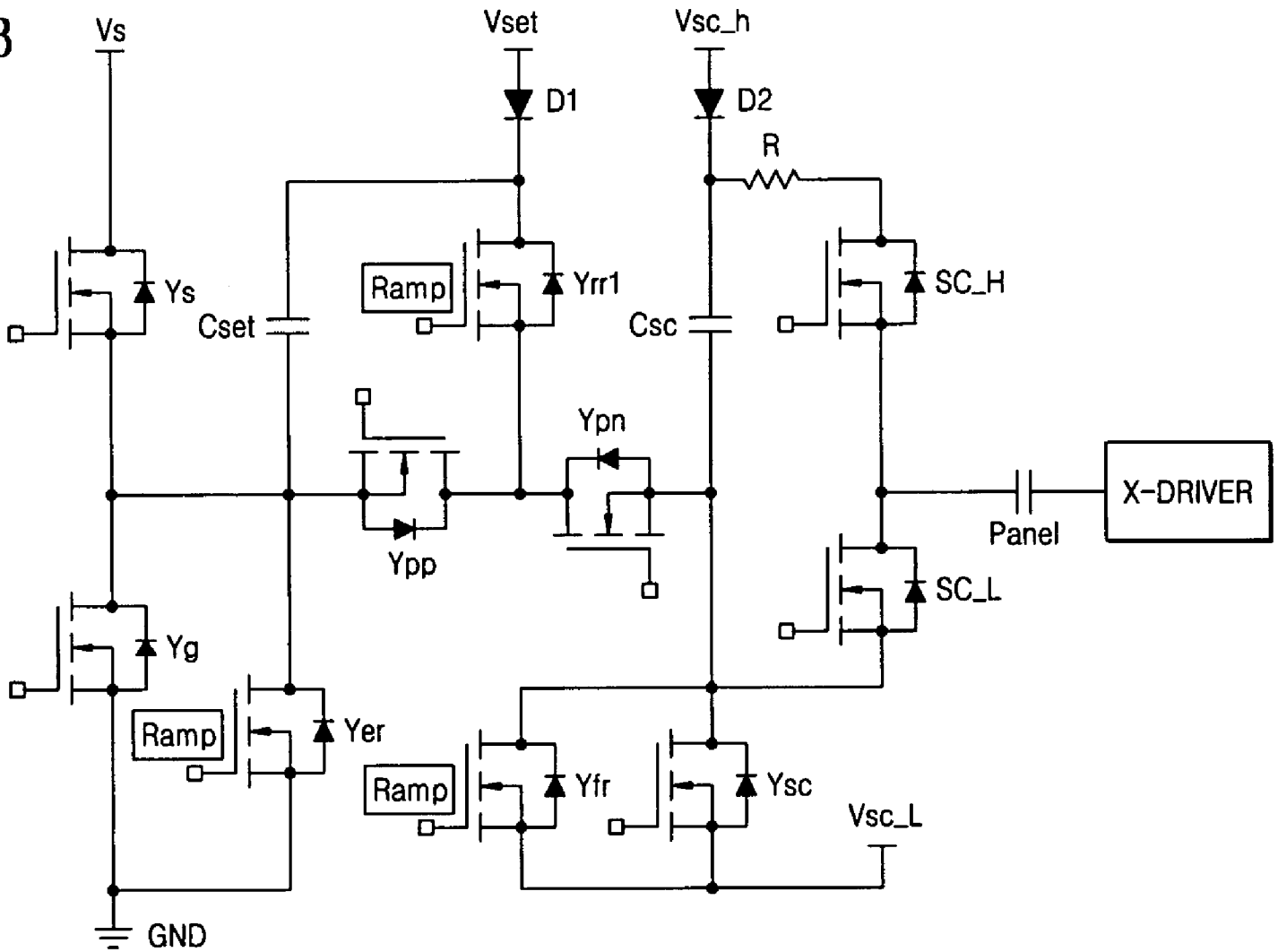
FIG. 8 is a circuit diagram showing a circuit for implementing the panel driving signals shown in FIG. 5.

FIG. 8 is a circuit diagram showing a circuit for implementing the driving signals shown in FIG. 5. Though not shown, an energy recovery circuit may be connected to a node between the switches $Y_s$ and $Y_g$. FIG. 8 is similar to FIG. 6 with an added switch $Y_{pn}$. The switch $Y_{pn}$ is provided to cut off the ground voltage and $V_{sc_L}$ in the address period PA when the scanning voltage $V_{sc_L}$ or $V_{sc_h}$ is lower than the ground voltage. Without the switch $Y_{pn}$, a conduction path may be generated via parasitic diodes of the switches $Y_g$, $Y_{pp}$, and SC_L. Other switching operations for generating the driving signals are similar to those of the circuit shown in FIG. 6.

Figure 9:
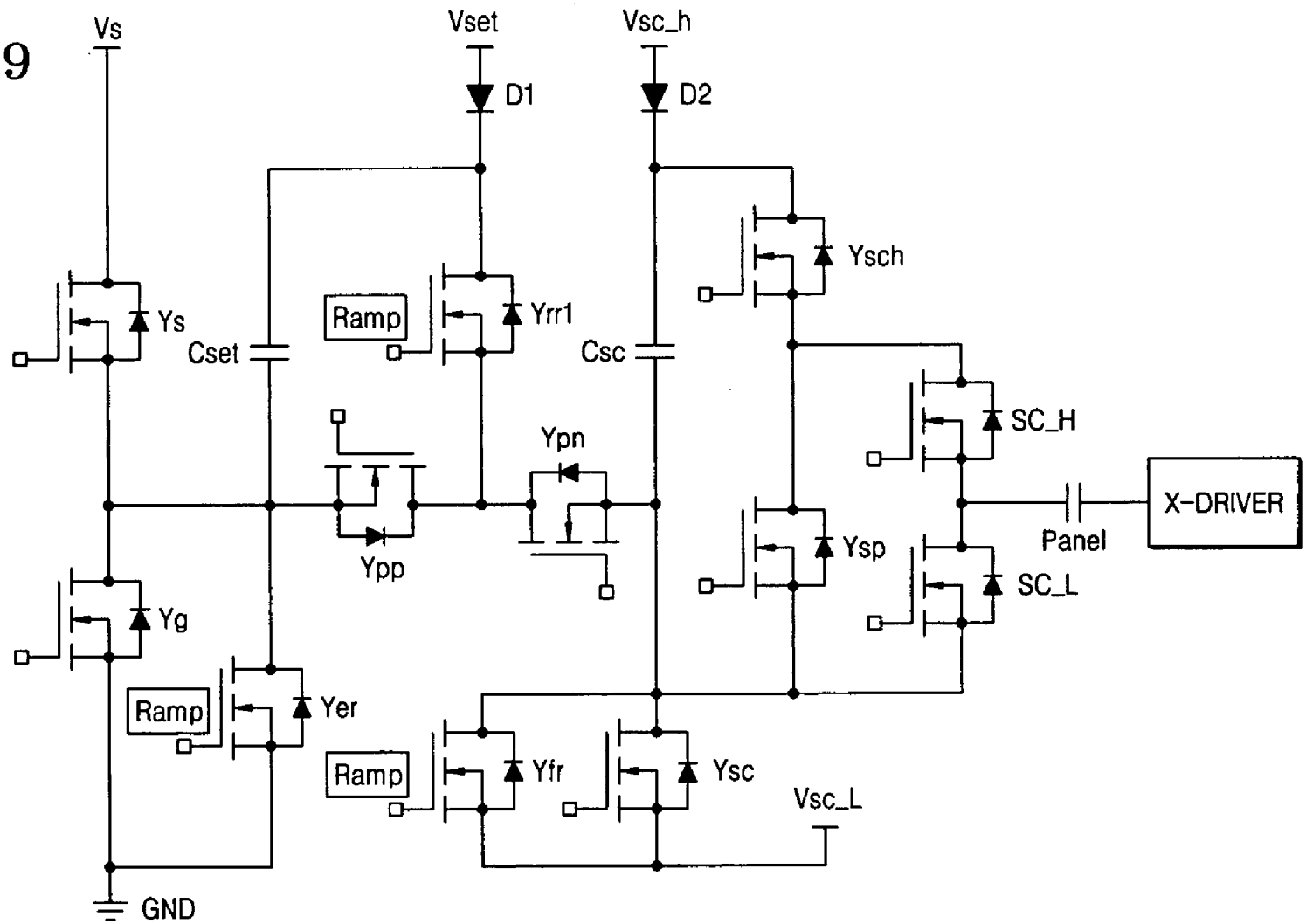
FIG. 9 is another circuit diagram showing a circuit for implementing the panel driving signals shown in FIG. 5.

FIG. 9 is another circuit diagram showing a circuit for implementing the driving signals shown in FIG. 5. As compared to FIG. 7, a switch $Y_{pn}$ is added to FIG. 9. The function of the switch $Y_{pn}$ is similar to that described in relation with FIG. 8. Other switching operations for generating the driving signals are similar to those of the circuit shown in FIG. 7.

In FIG. 6, FIG. 7, FIG. 8, and FIG. 9, the switch $Y_{pp}$ is provided to implement driving signals for the rising and falling ramp intervals during the reset period. Additionally, the rising ramp interval may be controlled by the switch SC_L, which is an input switch of a low level of scanning voltage of the scanning driving circuit. However, the switch $Y_{pp}$ is very expensive. Therefore, removing the switch $Y_{pp}$ may provide for a simpler and cheaper display panel driving circuit.

Hereinafter, a display panel driving apparatus according to exemplary embodiments of the present invention will be described with reference to the attached drawings. Like reference numerals in the drawings denote like elements.

A display panel driving apparatus according to exemplary embodiments of the present invention applies a rising ramp voltage that rises from a first voltage to a second voltage to at least one electrode included in a display panel in a reset period. For example, a display panel driving apparatus according to the present invention applies a rising ramp voltage that smoothly rises from a voltage $V_s$ to a voltage $V_s+V_{set}$ to scanning electrodes $Y_1$:$Y_n$ in a reset period PR as shown in FIG. 4 or 5.

A three-electrode display panel typically includes an address electrode, a scanning electrode, and a common electrode. According to exemplary embodiments of the present invention, the rising ramp voltage may be applied to at least one of these three electrodes.

Figure 10:
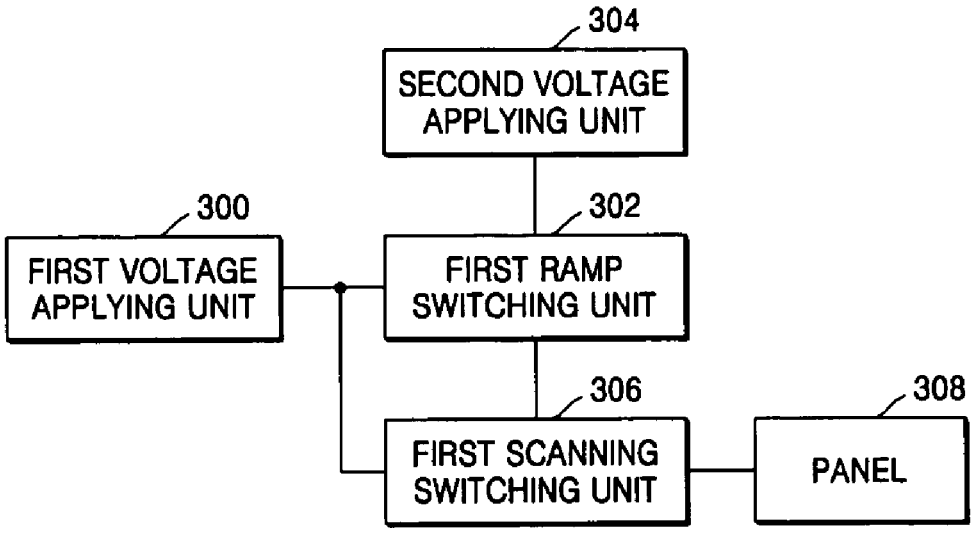
FIG. 10 is a block diagram showing a display panel driving apparatus according to an exemplary embodiment of the present invention.

FIG. 10 is a block diagram showing a display panel driving apparatus according to an exemplary embodiment of the present invention. The driving apparatus includes a first voltage applying unit 300, a second voltage applying unit 304, a first ramp switching unit 302, and a first scanning switching unit 306 to generate driving signals for an electrode of a panel 308.

The first voltage applying unit 300 applies a first voltage, which is an initial voltage of a rising ramp, to at least one electrode included in the display panel. The first voltage may have various levels, including a high level sustaining voltage $V_s$ of a sustain period.

The second voltage applying unit 304 applies a second voltage by which a termination voltage of the rising ramp is determined.

The first ramp switching unit 302 is coupled to the first voltage applying unit 300 and the second voltage applying unit 304, and it controls the rising ramp voltage that smoothly rises from the first voltage to the second voltage. Referring to the reset period PR shown in FIG. 4 or 5, the rising ramp voltage smoothly rises from a voltage $V_s$ to a voltage $V_s+V_{set}$ while the first ramp switching unit 302 controls the slope of the rising ramp.

The first scanning switching unit 306 is coupled between the electrode and the first ramp switching unit 302, and it applies a high level scanning voltage (i.e., $V_{SC-H}$ in FIG. 4) to the electrode. Additionally, according to an exemplary embodiment of the present invention, the driving apparatus applies the rising ramp voltage of the reset period PR to the electrode through the first scanning switching unit 306.

As a result, in the driving apparatus shown in FIG. 10, the first voltage is output from the first voltage applying unit 300, the first ramp switching unit 302 is turned on, and the first scanning switching unit 306 is turned on to apply the rising ramp voltage to the electrode.

Figure 11:
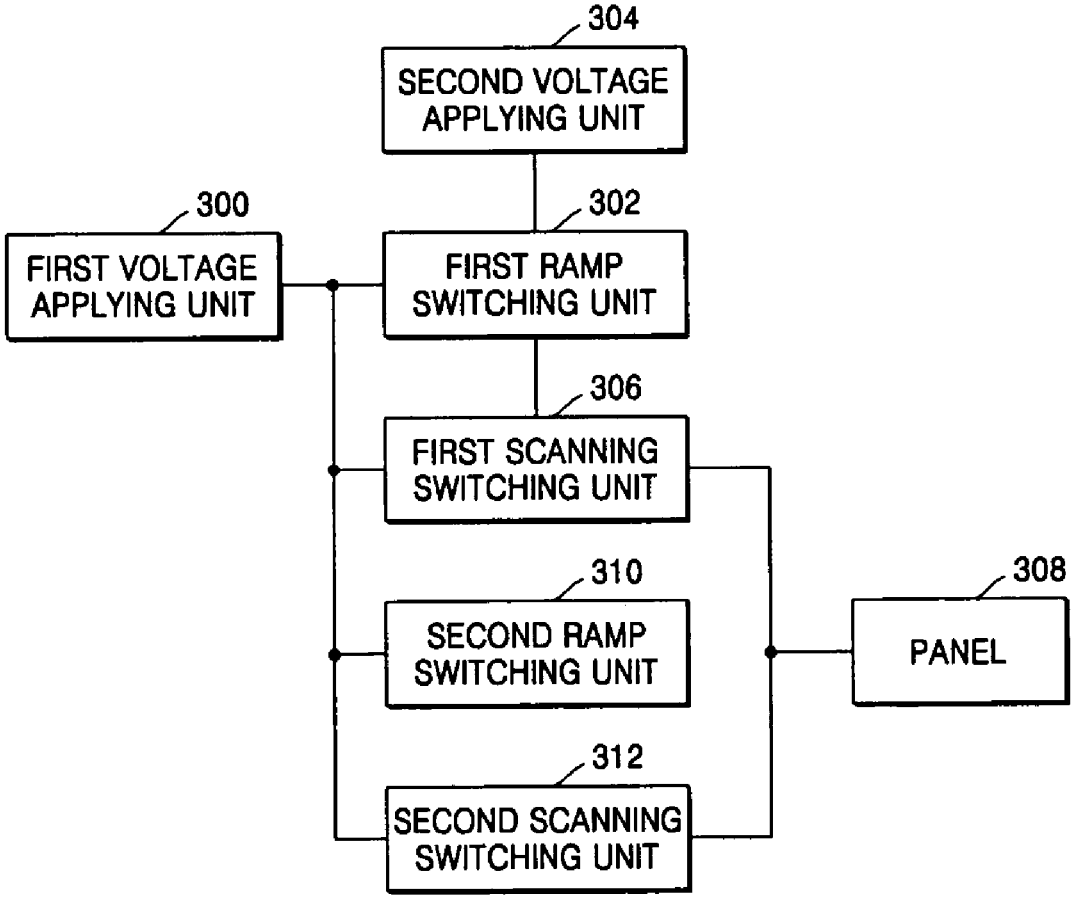
FIG. 11 is a block diagram showing a display panel driving apparatus according to an exemplary embodiment of the present invention.

FIG. 11 is a block diagram showing a display panel driving apparatus according to an exemplary embodiment of the present invention. The second ramp switching unit 310 and the second scanning switching unit 312 control a falling ramp voltage in the reset period.

Referring to the reset period PR shown in FIG. 4, the second ramp switching unit 310 controls the falling ramp interval $V_s$:$V_{SC-L}$. Though not shown in the drawing, the second ramp switching unit 310 may include a low level scanning voltage, and the second scanning switching unit 312 may apply the low level scanning voltage to the electrode.

The second ramp switching unit 310 may include the power source $V_{SC_L}$ and the switch $Y_{fr}$ shown in FIG. 6, FIG. 7, FIG. 8 and FIG. 9.

The second scanning switching unit 312 may include the power source $V_{SC_L}$, and the switches $Y_{sc}$ and SC_L shown in FIGS. 6 through 9.

Figure 12:
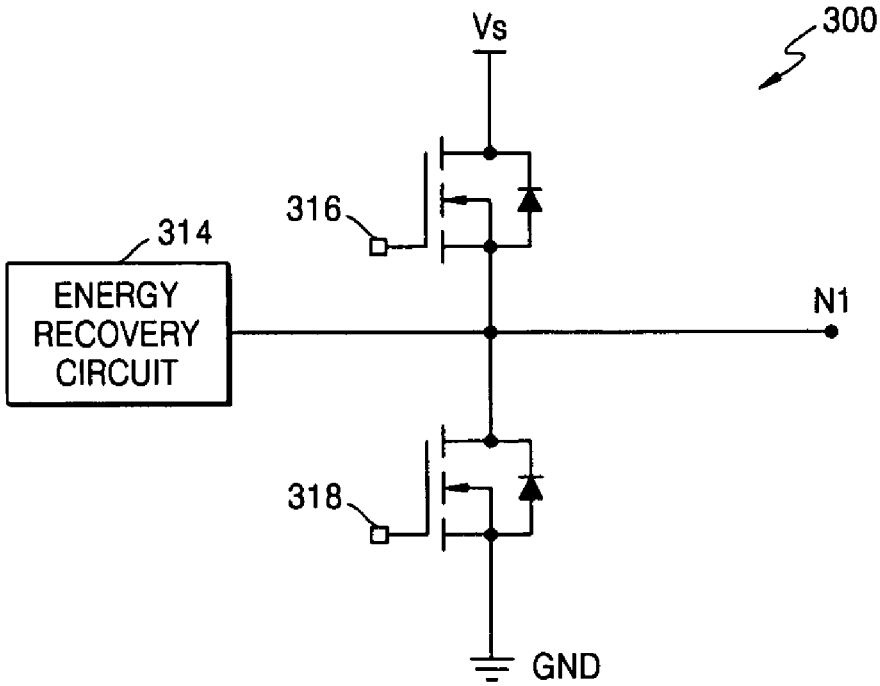
FIG. 12 is a circuit diagram showing a first voltage applying unit 300 of FIG. 11 according an exemplary embodiment of the present invention.

FIG. 12 is a circuit diagram showing a first voltage applying unit 300 of FIG. 10 and FIG. 11 according an exemplary embodiment of the present invention. The first voltage applying unit 300 may include a first power source $V_s$, a first switch 316, and a second switch 318.

The first switch 316 is coupled to the first power source $V_s$, and the second switch is coupled to a ground terminal GND. When the first switch 316 is turned on and the second switch 318 is turned off, the first voltage $V_s$ is output to a first node N1. When the first switch 316 is turned off and the second switch 318 is turned on, the ground voltage $V_G$ is output to the first node N1.

Additionally, the first voltage applying unit 300 may further include an energy recovery circuit 314 to improve the panel driving circuit's power consumption efficiency. The energy recovery circuit 314, which may comprise a capacitor and an inductor, improves power consumption efficiency by using an LC resonance between the panel capacitance and its inductor. U.S. Pat. Nos. 4,866,349 and 5,670,974 disclose examples of the energy recovery circuit 314.

Figure 13:
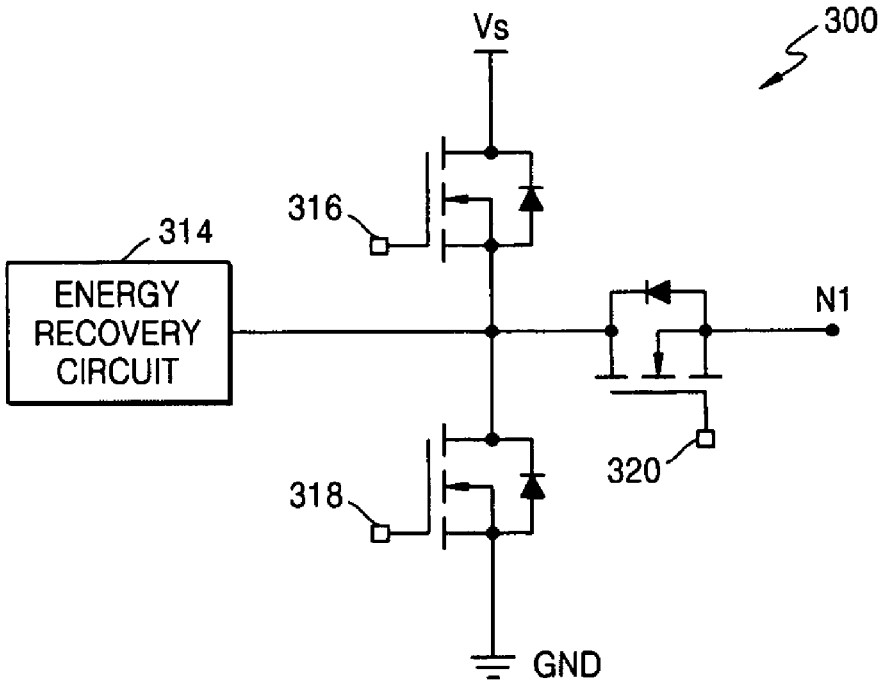
FIG. 13 is a circuit diagram showing a first voltage applying unit 300 of FIG. 11 according another exemplary embodiment of the present invention.

FIG. 13 is a circuit diagram showing a first voltage applying unit 300 of FIG. 10 and FIG. 11 according another exemplary embodiment of the present invention. The first voltage applying unit 300 of FIG. 13 includes a first switch 316, a second switch 318, and a third switch 320.

The third switch 320 may prevent a conduction path from generating between the first node N1 and the ground terminal GND when the ground voltage exceeds the voltage of the first node N1. Without the third switch, a conduction path may be generated between the first node N1 and the ground terminal GND due to a body diode of the second switch 318.

When the first switch 316 and the third switch 320 are turned on, and the second switch 318 is turned off, the first voltage $V_s$ is output to the first node N1. When the first switch 316 is turned off, and the second switch 318 and the third switch 320 are turned on, the ground voltage $V_G$ is output to the first node N1.

Figure 14:
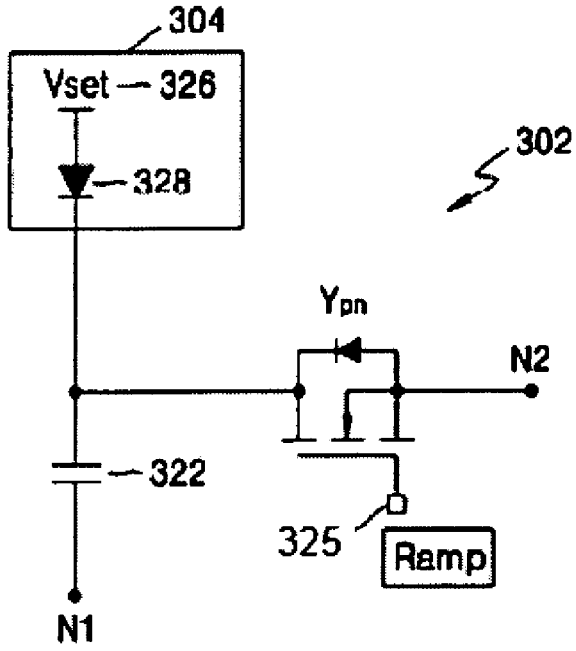
FIG. 14 is a circuit diagram showing a second voltage applying unit 304 and a first ramp switching unit 302 of FIG. 11 according to an exemplary embodiment of the present invention.

FIG. 14 is a circuit showing a second voltage applying unit 304 and a first ramp switching unit 302 of FIG. 10 and FIG. 11 according to an exemplary embodiment of the present invention. The second voltage applying unit 304 may include a second power source 326 and a first diode 328. The first ramp switching unit 302 may include a first capacitor 322 and a fourth switch 325.

A second voltage $V_{set}$ is slowly charged by the first capacitor 322. A circuit for controlling the rising ramp voltage may be coupled to the first capacitor 322 and the fourth switch 325. The circuit for controlling the rising ramp voltage includes at least a resistor, and a capacitor to control the slope of the rising ramp.

As a result, a rising ramp voltage that smoothly rises from the voltage of the first node N1 to the second voltage $V_{set}$ may be output to the second node N2.

Figure 15:
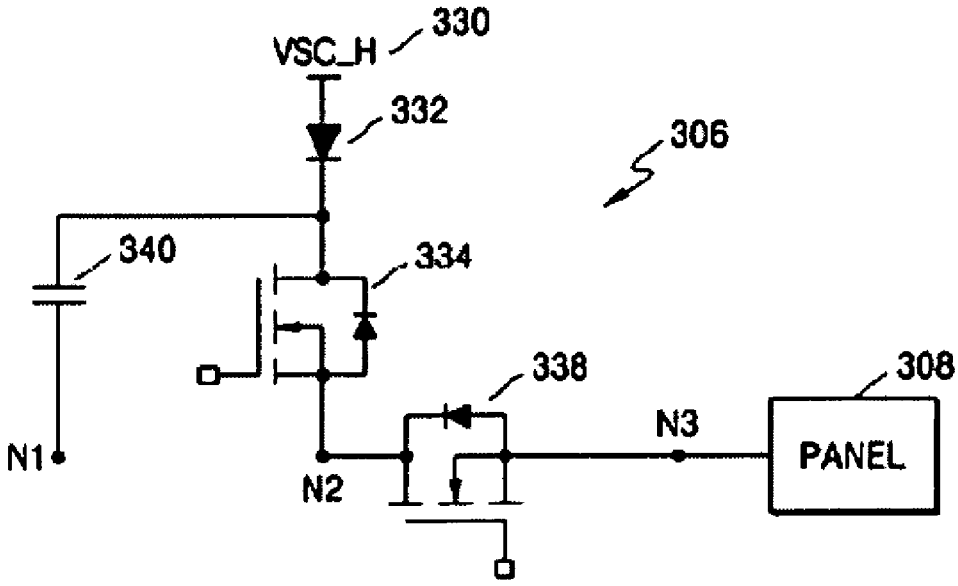
FIG. 15 is a circuit diagram showing a first scanning switching unit 306 of FIG. 11 according to an exemplary embodiment of the present invention.

FIG. 15 is a circuit diagram showing a first scanning switching unit 306 of FIG. 10 and FIG. 11 according to an exemplary embodiment of the present invention. The first scanning switching unit 306 may include scanning power source units 330 and 332, a second capacitor 340, a fifth switch 334, and a sixth switch 338.

The scanning power source unit may include a scanning power source $V_{SC_H}$ 330 and a second diode 332 for protecting the scanning power.

A voltage equal to a difference between a high level scanning voltage $V_{SC_H}$ and the voltage of the first node N1 may be applied to the terminals of the second capacitor 340.

The fifth switch 334 is coupled between the scanning power source 330 and the first ramp switching unit 302 to apply a high level scanning voltage $V_{SC_H}$ to the second node N2. The fifth switch 334 operates in an address period.

The sixth switch 338 is coupled between the first switch unit 302 and the electrode to apply the voltage of the second node N2 to the panel 308.

Figure 16:
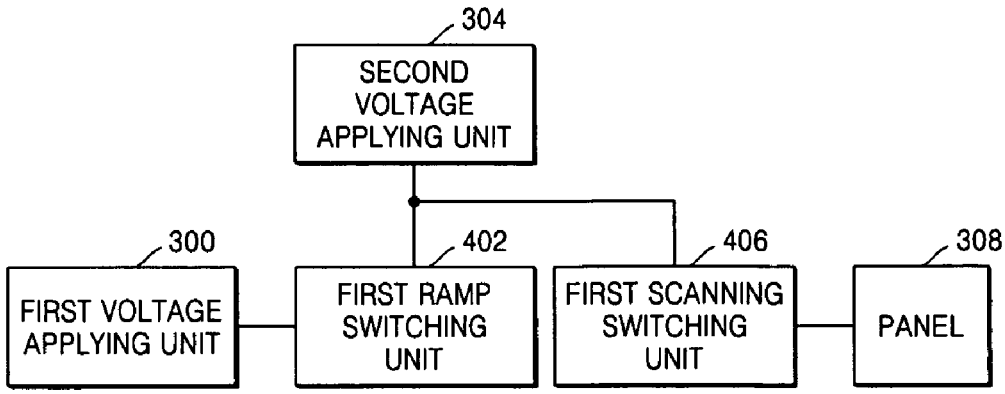
FIG. 16 is a block diagram showing a display panel driving apparatus according to another exemplary embodiment of the present invention.

FIG. 16 is a block diagram showing a display panel driving apparatus according to another exemplary embodiment of the present invention. The driving apparatus includes a first voltage applying unit 300, a second voltage applying unit 304, a first ramp switching unit 402, and a first scanning switching unit 406 to generate a driving signal for the panel 308. FIG. 16 shows a case where the second voltage $V_{set}$ is equal to the high level scanning voltage $V_{SC_H}$ and the first scanning switching unit 406 is coupled to the second voltage applying unit 304.

The first voltage applying unit 300 applies the first voltage, which is an initial voltage of the rising ramp voltage, to at least one electrode included in the display panel. The first voltage may have various levels. For example, it may be equal to a high level sustaining voltage $V_s$ of a sustain period.

The second voltage applying unit 304 applies the second voltage by which a termination voltage of a rising ramp is determined.

The first ramp switching unit 402 is coupled to the first voltage applying unit 300 and the second voltage applying unit 304, and it controls the rising ramp voltage that smoothly rises from the first voltage to the second voltage. Referring to the reset period PR shown in FIG. 4 or 5, the rising ramp voltage smoothly rises from a voltage $V_s$ to a voltage $V_s+V_{set}$ while the first ramp switching unit 402 controls the slope of the rising ramp.

The first scanning switching unit 406 is coupled to the node between the second voltage applying unit 304 and the first ramp switching unit 402, and it applies a high level scanning voltage (i.e., $V_{SC\text{-}H}$ in FIG. 4) to the electrode of the panel 308. A display panel driving apparatus according to an exemplary embodiment of the present invention applies the rising ramp voltage of the reset period PR to the electrode through the first scanning switching unit 406. A high level scanning voltage $V_{SC\text{-}H}$ may equal the second voltage $V_{set}$.

As a result, in the driving apparatus shown in FIG. 16, the first voltage is output from the first voltage applying unit 300, the first ramp switching unit 402 is turned on, and the first scanning switching unit 406 is turned on to apply the rising ramp voltage to the electrode.

Figure 17:
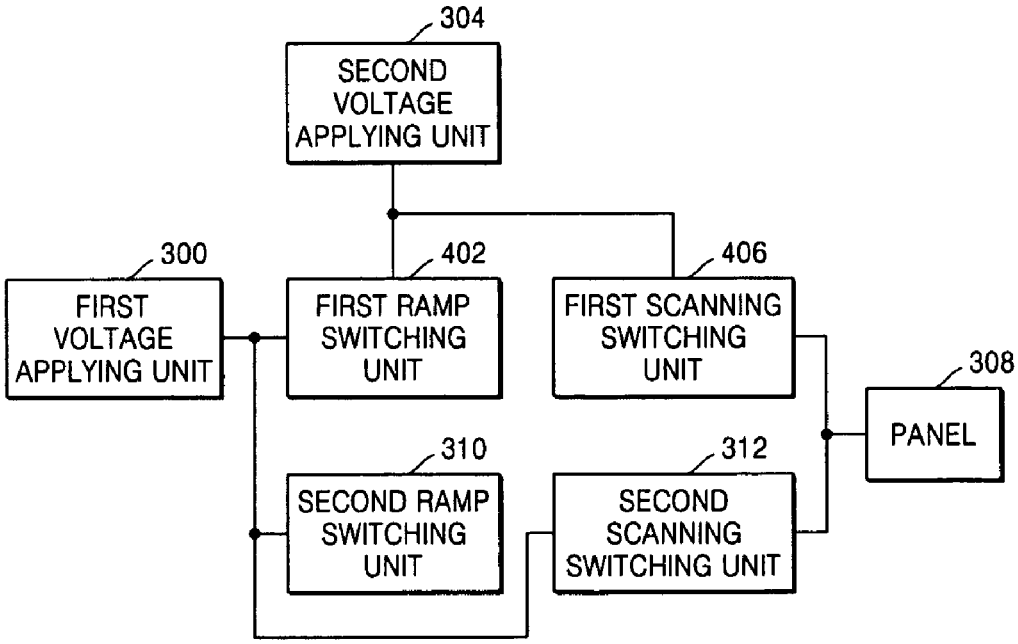
FIG. 17 is a block diagram showing a display panel driving apparatus according to another exemplary embodiment of the present invention.

FIG. 17 is a block diagram showing a display panel driving apparatus according to another exemplary embodiment of the present invention. The driving apparatus of FIG. 17 further includes a second ramp switching unit 310 and a second scanning switching unit 312.

Referring to the reset period PR shown in FIG. 4, the second ramp switching unit 310 controls the falling ramp interval $V_s$:$V_{SC\text{-}L}$. Though not shown, the second ramp switching unit 310 includes a low level scanning voltage, and the second scanning switching unit 312 applies the low level scanning voltage to the electrode.

The second ramp switching unit 310 may include the power source $V_{SC_L}$ and the switch $Y_{fr}$ shown in FIG. 6, FIG. 7, FIG. 8 and FIG. 9.

The second scanning switching unit 312 may include the power source $V_{SC_L}$, and the switches $Y_{sc}$ and SC_L shown in FIGS. 6 through 9.

Figure 18:
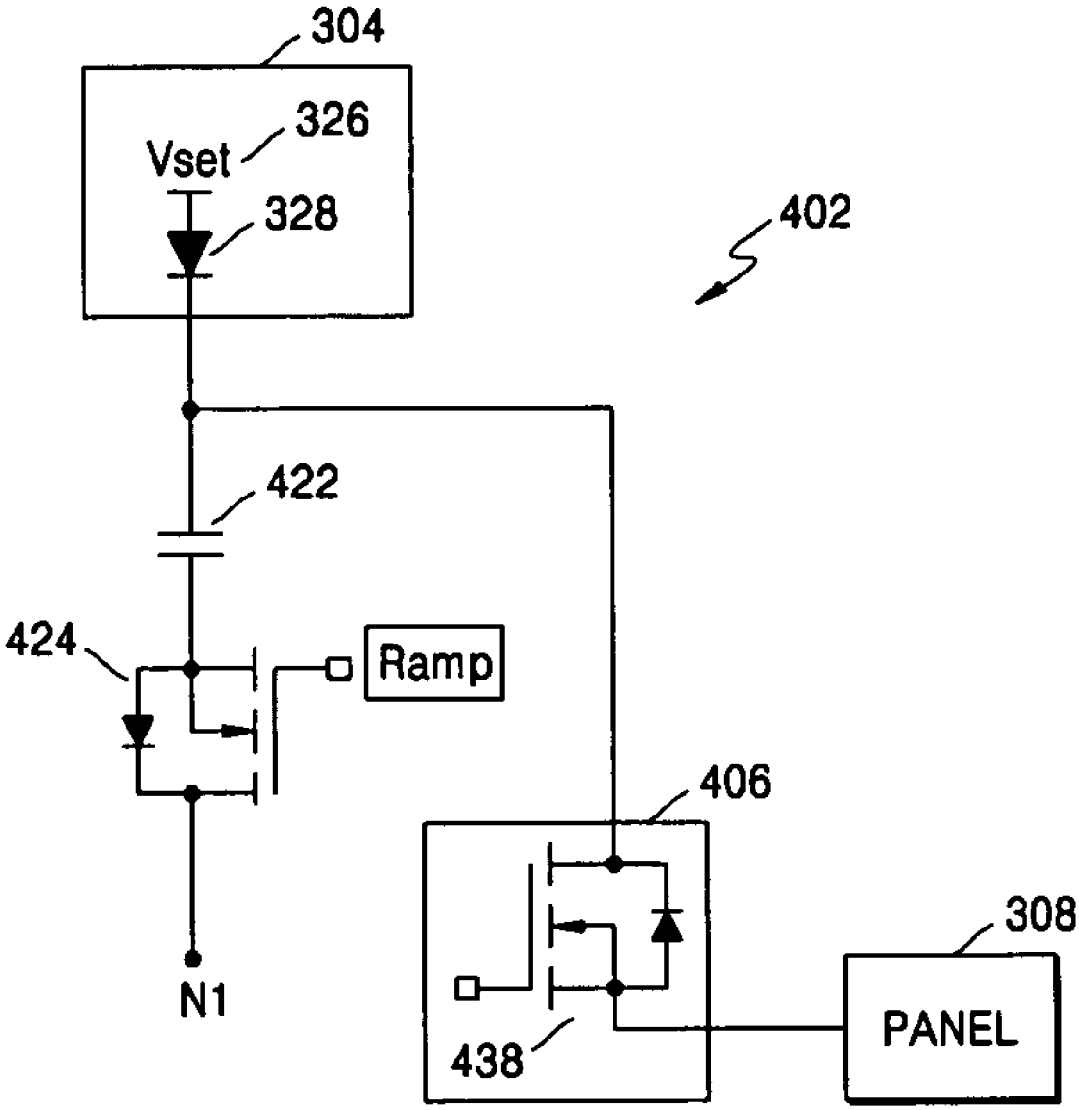
FIG. 18 is a circuit diagram showing a second voltage applying unit 304, a first ramp switching unit 402, and a first scanning switching unit 406 of FIG. 16 according an exemplary embodiment of the present invention.

FIG. 18 is a circuit diagram showing the second voltage applying unit 304, the first ramp switching unit 402, and the first scanning switching unit 406 of FIG. 16 according an exemplary embodiment of the present invention. The second voltage applying unit 304 may include a second power source $V_{set}$ 326 and a first diode 328. The first ramp switching unit 402 may include a first capacitor 422 and a fourth switch 424 coupled with each other in series between the first node N1 and the second voltage applying unit 304.

The second voltage $V_{set}$ may be slowly charged by the first capacitor 422. A circuit for controlling the rising ramp voltage may be coupled to the first capacitor 422 and the fourth switch 424. The circuit for controlling the rising ramp voltage may include at least a resistor, and a capacitor to control the slope of the rising ramp.

Additionally, the first scanning switching unit 406 may be implemented by one switch 438.

As a result, a rising ramp voltage that smoothly rises from the voltage of the first node N1 to the second voltage $V_{set}$ may be output to the panel 308 through the first scanning switching unit 406.

Figure 19:
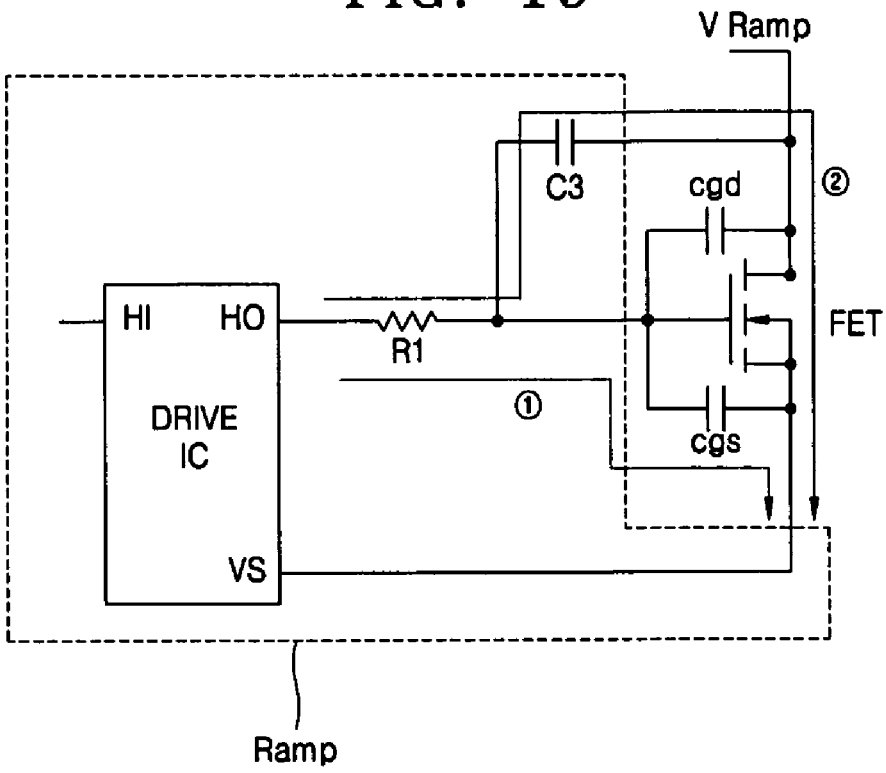
FIG. 19 is a circuit diagram showing a circuit for controlling a slope of the rising ramp voltage of FIG. 14 and FIG. 18 according to an exemplary embodiment of the present invention.

FIG. 19 is a circuit diagram showing a circuit for controlling a slope of the rising ramp voltage of FIG. 14 and FIG. 18 according to an exemplary embodiment of the present invention. As shown in FIG. 19, a capacitor C3 is arranged between a gate and a drain of an FET (field-effect transistor) to generate a ramp pulse. That is, in order to completely turn on the FET, it is required to charge a parasitic capacitance Cgs between the gate and the source of the FET, and to charge a parasitic capacitance Cgd between the gate and the drain thereof.

In this instance, when the capacitor C3 is added to the parasitic capacitance Cgd to charge the parasitic capacitance Cgs, a time frame from a time when the FET having a voltage greater than a threshold value starts being turned on to a time when the FET is completely turned on can be extended to some degree.

Accordingly, the parasitic capacitance Cgs is charged through ① to slightly open the FET, the gate current is applied to the panel through a path ②, and the charged parasitic capacitance Cgs is discharged to close the FET. In this instance, path ① and path ② cause a negative feedback effect to each other to allow the FET to operate as a constant current source.

Figure 20:
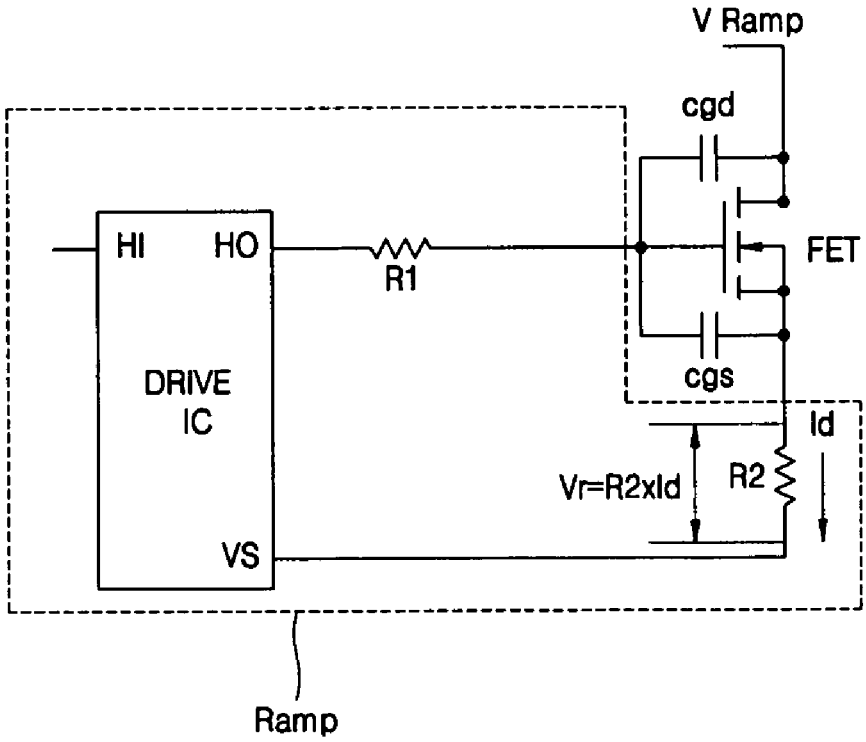
FIG. 20 is a circuit diagram showing a circuit for controlling a slope of the rising ramp voltage of FIG. 14 and FIG. 18 according to another exemplary embodiment of the present invention.

FIG. 20 is a circuit diagram showing a circuit for controlling a slope of the rising ramp voltage of FIG. 14 and FIG. 18 according to another exemplary embodiment of the present invention. As shown in FIG. 20, a resistor R2 is arranged between a source of the FET and a terminal Vs of a FET drive IC to generate a constant current source.

As shown in FIG. 19, when the gate current charges the parasitic capacitance Cgs to open the FET, current Id starts flowing. The current Id charges the parasitic capacitance Cgd and steeply rises, but it generates a voltage drop of Vr at the resistor R2 to reduce the intensity of the voltage charged to the parasitic capacitance Cgs, because the potential difference between the terminal Vs of the FET drive IC and a terminal HO for outputting a gate has a constant voltage Vcc (generally 12 to 18V).

When the voltage at Cgs reduces, the FET is closed to reduce the current Id. When the current Id reduces, the voltage drop Vr also reduces, and the voltage at Cgs increase to open the FET again.

The above-noted operation is negative feedback effect to allow the FET to operate as a constant current source.

According to exemplary embodiments of the present invention, a ramp reset signal may be generated even without a path switch $Y_{pp}$, shown in FIG. 6, FIG. 7, FIG. 8 and FIG. 9 and included in the conventional art to carry out a rising ramp interval in the reset period. Therefore, a panel driving circuit may be simplified and cheaper to produce.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display panel driving apparatus for applying a rising ramp voltage rising from a first voltage to a second voltage in a reset period to at least one electrode included in a display panel, comprising:

a first voltage applying unit to output the first voltage;

a second voltage applying unit to output the second voltage;

a first ramp switching unit coupled between the first voltage applying unit and the second voltage applying unit to control the rising ramp voltage; and a first scanning switching unit coupled between the first voltage applying unit and the electrode and between the first ramp switching unit and the electrode to apply a high level scanning voltage to the electrode, wherein the rising ramp voltage is applied to the electrode when the first voltage is output from the first voltage applying unit, the first ramp switching unit is turned on, and the first scanning switching unit is turned on.

2. The display panel driving apparatus of claim 1, wherein the first voltage applying unit comprises:

a first switch coupled to a power source of the first voltage; and a second switch coupled to a ground terminal, wherein the first voltage is output when the first switch is turned on and the second switch is turned off.

3. The display panel driving apparatus of claim 2, wherein the first voltage applying unit further comprises a third switch coupled between the first switch and the second switch; and wherein the first voltage is output when the first switch is turned on, the second switch is turned off, and the third switch is turned on.

4. The display panel driving apparatus of claim 1, wherein the first voltage applying unit comprises an energy recovery circuit.

5. The display panel driving apparatus of claim 1, wherein the first ramp switching unit comprises:

a first capacitor coupled between the first voltage applying unit and the second voltage applying unit; and a fourth switch coupled to a node between the second voltage applying unit and the first capacitor.

6. The display panel driving apparatus of claim 5, wherein a circuit for controlling a slope of the rising ramp voltage is coupled to the fourth switch.

7. The display panel driving apparatus of claim 1, wherein the first scanning switching unit comprises:

a scanning power source;

a fifth switch coupled to the scanning power source and the first ramp switching unit; and a sixth switch coupled between the first ramp switching unit and the electrode.

8. A display panel driving apparatus for applying a rising ramp voltage rising from a first voltage to a second voltage in a reset period to at least one electrode included in a display panel, comprising:

a first voltage applying unit ,to output the first voltage;

a second voltage applying unit to output the second voltage;

a first ramp switching unit coupled between the first voltage applying unit and the second voltage applying unit to control the rising ramp voltage; and a first scanning switching unit coupled to the second voltage applying unit and the first ramp switching unit to apply the second voltage to the electrode as a high level scanning voltage, wherein the rising ramp voltage is applied to the electrode when the first voltage is output from the first voltage applying unit, the first ramp switching unit is turned on, and the first scanning switching unit is turned on.

9. The display panel driving apparatus of claim 8, wherein the first voltage applying unit comprises:

a first switch coupled to a power source of the first voltage; and a second switch coupled to a ground terminal, wherein the first voltage is output when the first switch is turned on and the second switch is turned off.

10. The display panel driving apparatus of claim 9, wherein the first voltage applying unit further comprises a third switch coupled between the first switch and the second switch; and wherein the first voltage is output when the first switch is turned on, the second switch is turned off, and the third switch is turned on.

11. The display panel driving apparatus of claim 8, wherein the first voltage applying unit comprises an energy recovery circuit.

12. The display panel driving apparatus of claim 8, wherein the first ramp switching unit comprises a first capacitor and a fourth switch coupled with each other in series between the first voltage applying unit and the second voltage applying unit.

13. The display panel driving apparatus of claim 12, wherein a circuit for controlling a slope of the rising ramp is coupled to the fourth switch.

14. The display panel driving apparatus of claim 8, wherein the first scanning switching unit comprises a sixth switch coupled between the first ramp switching unit and the electrode.

* * * * *